US008044875B2

(12) United States Patent
Nishino et al.

(10) Patent No.: US 8,044,875 B2
(45) Date of Patent: Oct. 25, 2011

(54) COIL PARTS

(75) Inventors: Tatsumi Nishino, Tokyo (JP); Fumihito Meguro, Tokyo (JP); Takehiro Nakano, Tokyo (JP)

(73) Assignee: Sumida Corporation (JP)

( * ) Notice: Subject to any disclaimer, the term of this patent is extended or adjusted under 35 U.S.C. 154(b) by 68 days.

(21) Appl. No.: 12/296,702

(22) PCT Filed: Mar. 29, 2007

(86) PCT No.: PCT/JP2007/056774

§ 371 (c)(1),
(2), (4) Date: Aug. 5, 2009

(87) PCT Pub. No.: WO2007/116797

PCT Pub. Date: Oct. 18, 2007

(65) Prior Publication Data

US 2009/0309803 A1 Dec. 17, 2009

(30) Foreign Application Priority Data

Apr. 10, 2006 (JP) ..... 2006-107850

(51) Int. Cl.
*H01Q 7/08* (2006.01)

(52) U.S. Cl. ..... 343/788; 343/867

(58) Field of Classification Search ..... 343/867, 343/788, 895

See application file for complete search history.

(56) References Cited

U.S. PATENT DOCUMENTS

| | | | | |
|---|---|---|---|---|
| 7,068,223 | B2 * | 6/2006 | Yoshida et al. | 343/700 MS |
| 2007/0132335 | A1 * | 6/2007 | Ionel et al. | 310/261 |

FOREIGN PATENT DOCUMENTS

| | | |
|---|---|---|
| EP | 1376762 A1 | 1/2004 |
| EP | 2009739 A1 | 12/2008 |
| JP | 2003-298348 | 10/2003 |
| JP | 2004-229144 | 8/2004 |
| JP | 2005-348552 | 12/2005 |
| WO | 2005/088767 | 9/2005 |
| WO | 2005/112226 | 11/2005 |

OTHER PUBLICATIONS

European Search Report for Application No./Patent No. 07740212.1-2220 / 2012389 PCT/JP2007056774 dated Apr. 22, 2010 with English Abstract.

International Search Report for International Patent Application No. PCT/JP2007/056774 mailed May 29, 2007 with English Translation.

* cited by examiner

*Primary Examiner* — Tan Ho

(74) *Attorney, Agent, or Firm* — Cantor Colburn LLP

(57) ABSTRACT

A coil part used in a antenna coil has a cross shape core that includes: a first winding frame part extending a first direction and being provided with a coil, and a second winding frame part extending a direction crossing the first direction and being provided with a coil. A first core including the first winding frame part is interlocked with a second core 20*b* including the second winding frame part.

4 Claims, 6 Drawing Sheets

[Figure 1]
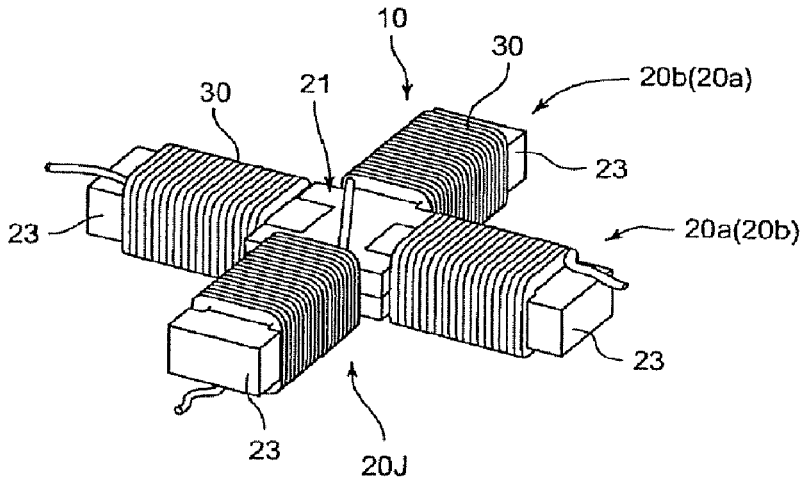
[Figure 2]
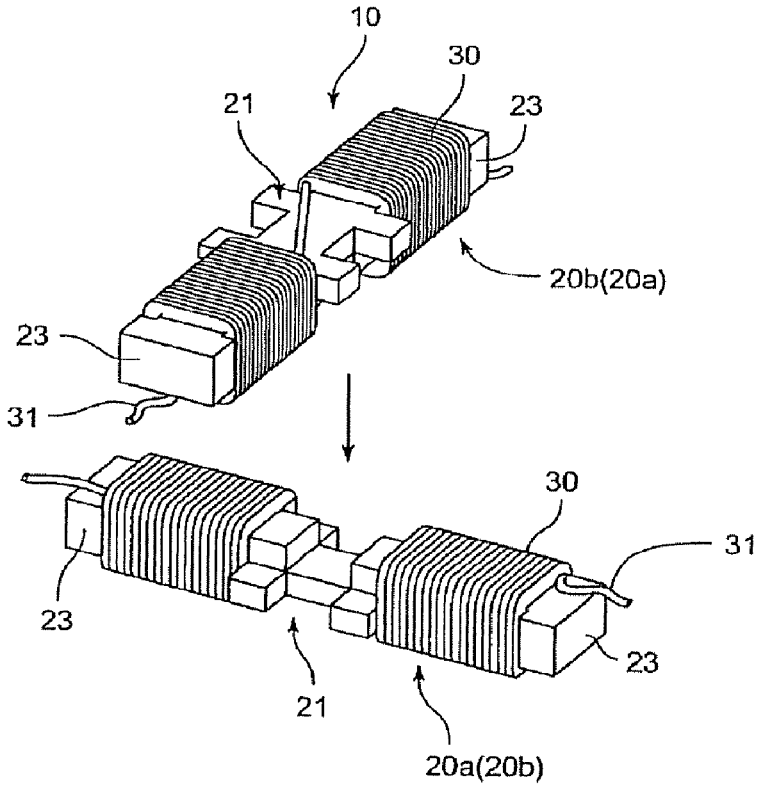

[Figure 3]
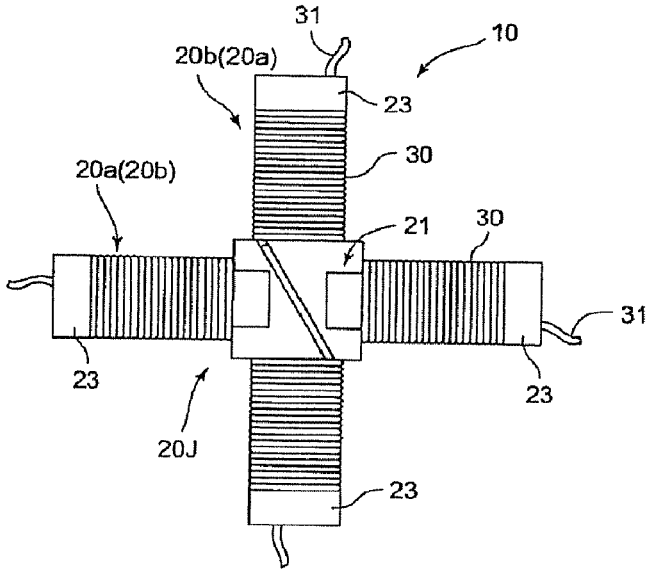
[Figure 4]
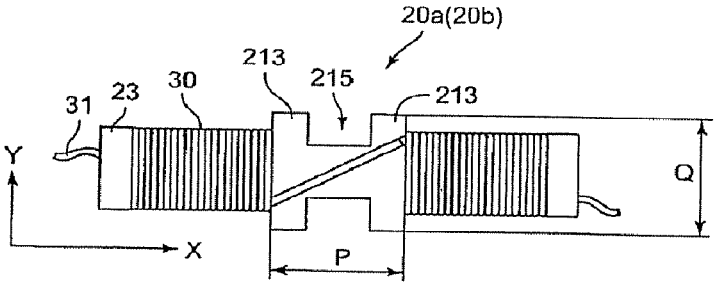
[Figure 5]
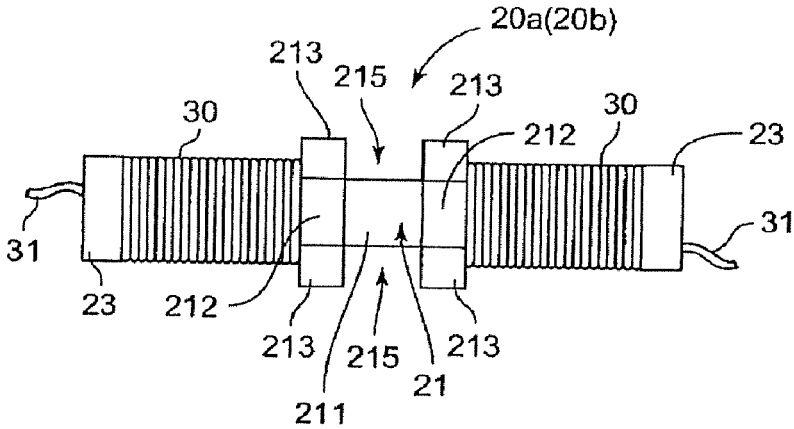

[Figure 6]
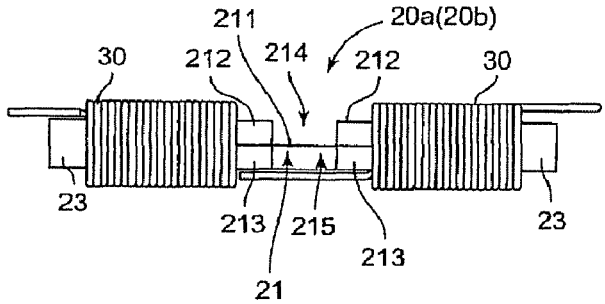
[Figure 7]
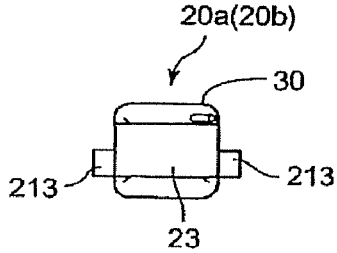
[Figure 8]
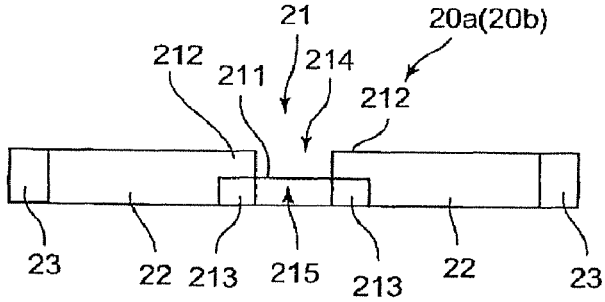
[Figure 9]
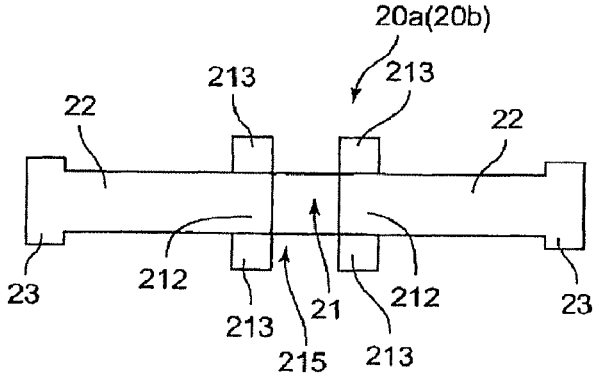

[Figure 10]
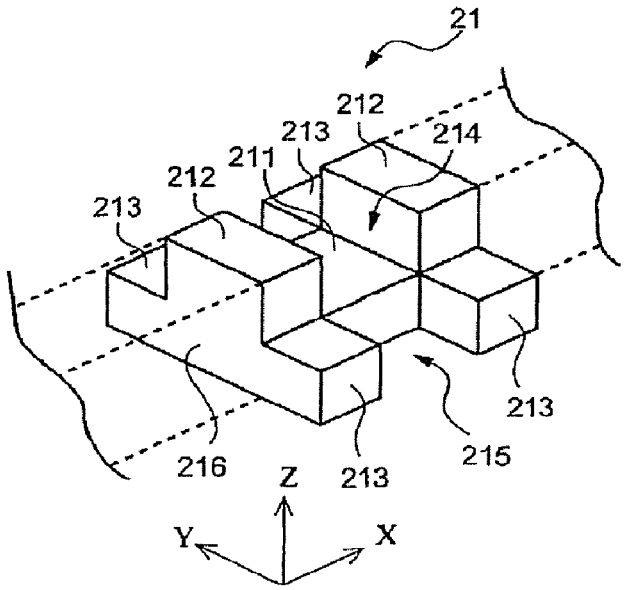
[Figure 11]
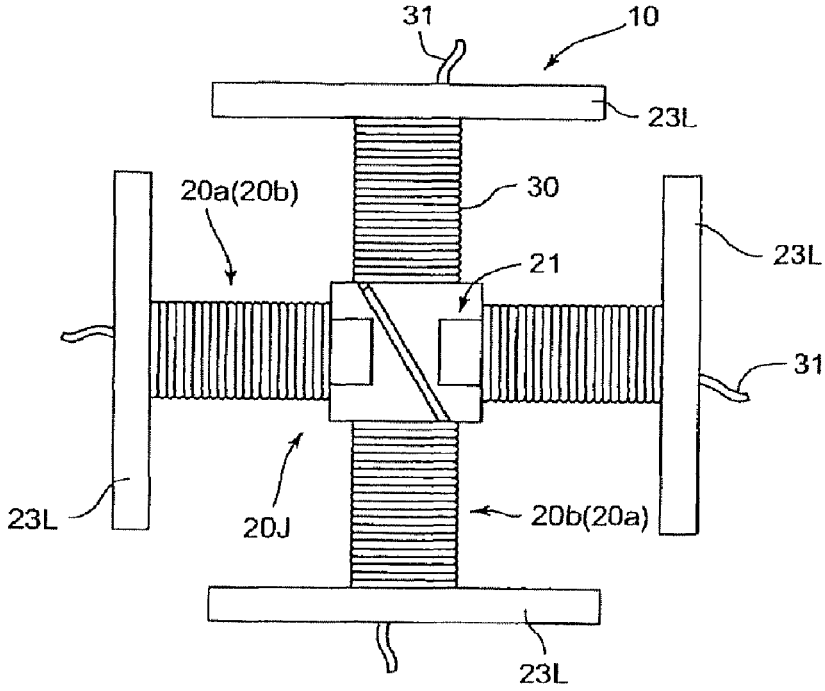

[Figure 12]
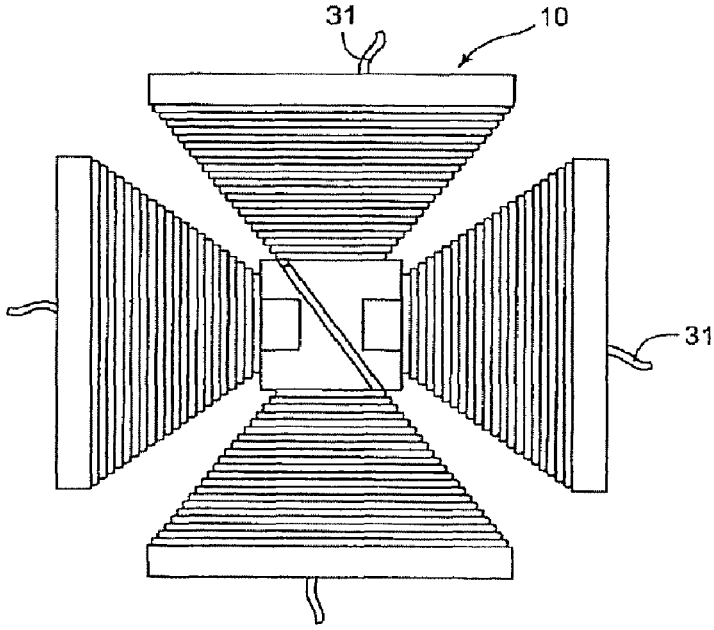
[Figure 13]
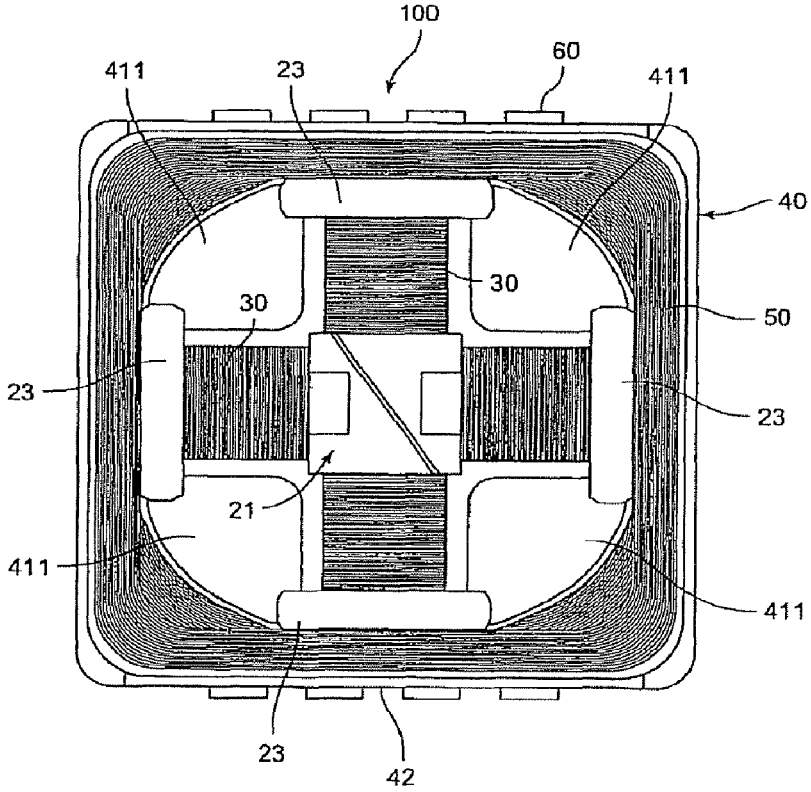

[Figure 14]
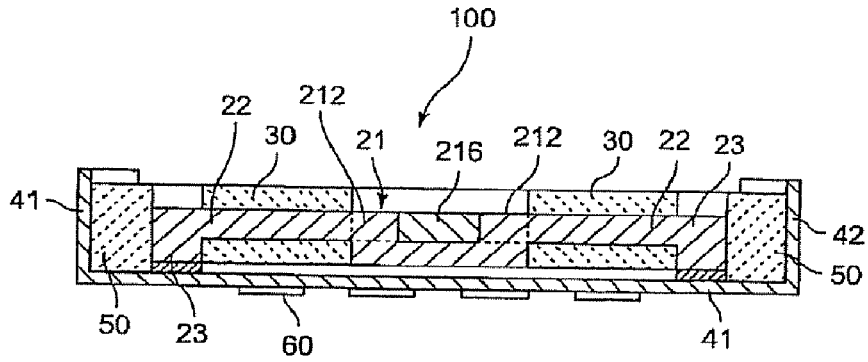
[Figure 15]
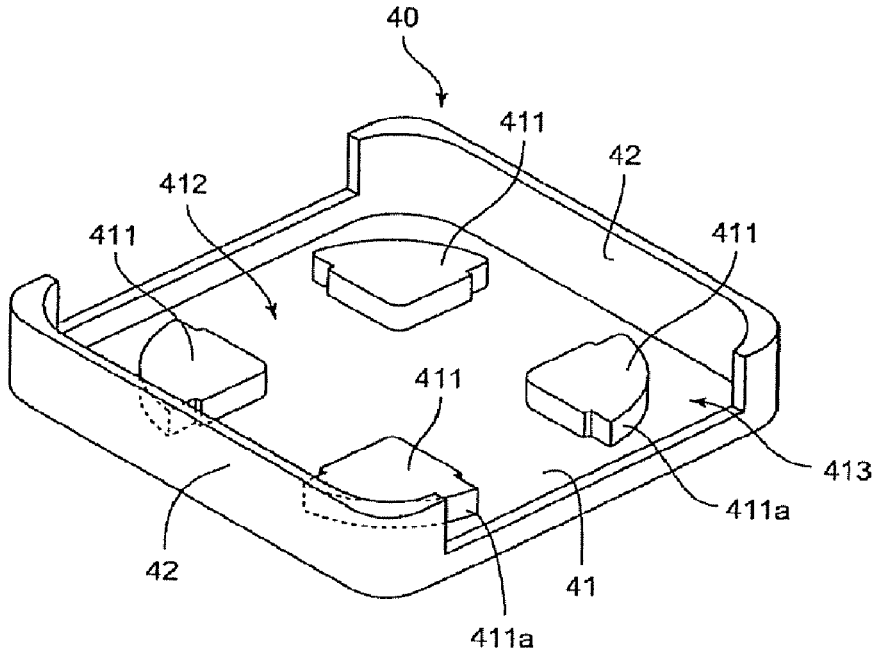

COIL PARTS

CROSS REFERENCE TO RELATED APPLICATIONS

This is a U.S. national stage of application No. PCT/JP2007/056774, filed on 29 Mar. 2007. Priority under 35 U.S.C. §119(a) and 35 U.S.C. §365(b) is claimed from Japanese Application No. 2006-107850, filed 10 Apr. 2006, the disclosure of which is also incorporated herein by reference.

TECHNICAL FIELD

The present invention relates to a coil part for an antenna coil that is used, for instance, for a remote keyless entry system of a car.

BACKGROUND OF TECHNOLOGY

A remote keyless entry system or a smart entry system used for various types of operations such as locking and unlocking a car door is coming to widespread use. In a remote keyless entry system, a transmission device carried by a user sends a radio wave that contains a prescribed code to a reception device placed on a car. Subsequently, the reception device receives this radio wave, and locks or unlocks a door only when the code stored in a memory of a control device placed on a car matches with the prescribed code mentioned above.

Some reception devices are provided with an antenna coil that can receive a radio wave in three axial directions. For example, the patent document 1 discloses a technology of an antenna coil capable of receiving a radio wave in three axial directions.

[Patent document 1] WO2005/088767 [Refer to FIGS. 1, 5 and 6]

DISCLOSURE OF THE INVENTION

Problem to be Solved

The core of the antenna coil disclosed in the patent document 1, however, brings a disadvantage in that it is uneasy to wind a wire around the core because of its cross shape core. For instance, when winding a wire around the cross shape core such as the type disclosed in the patent document 1 from one end of the x-axis arm(which stretches in the x-axis direction) to its other end, the nozzle of a winding machine cannot come in close distance to the x-axis arm at its midpoint area because the y-axis arm is fixed at this area.

Thus, the y-axis arm becomes an obstacle when winding a wire around the x-axis arm. In order to the obstacle, when winding a wire from one end of the x-axis arm over the midpoint area to its other end, the x-axis arm must be rotated 180 degrees and re-chucked after completing the wiring onto one side of the x-axis arm. The wiring resumes on the other side of the x-axis arm after this chucking is completed.

Such process, however, causes production inefficiency of chucking the core in total of four times when winding a wire around the cross shape core: one of the x-axis arm direction, the opposite x-axis arm direction, one of the y-axis arm direction and the opposite y-axis arm direction.

Further, the conventional configuration has a disadvantage when enhancing the sensitivity of an antenna coil, because of the difficulty of this configuration to satisfy a demand for downscaling in addition to a demand for the sensitivity enhancement.

In order to address such problem, the purpose of the present invention is to provide a coil part for an antenna coil that improves production efficiency and simultaneously enhances its sensitivity.

Means to Solve the Problem

According to an aspect of the invention, a coil part used in a antenna coil contains a cross shape core that includes: a first winding frame part extending a first direction and being provided with a coil, and a second winding frame part extending a direction crossing the first direction and being provided with a coil. Further, in the aspect, a first core including the first winding frame part is interlocked with a second core including the first winding frame part.

In this aspect, the cross shape core is formed by interlocking the first core possessing the first winding frame part with the second core possessing the second winding frame part. This interlocking enables a coil to be formed by winding wires around the first winding frame part and the second winding frame part independently, while the first core and the second core are in a detached state.

Accordingly, when winding wires around the first winding frame part and the second winding frame part, the nozzle of a winding machine can get close to the first winding frame part and the second winding frame part. Therefore, the nozzle is not prevented from any obstacle in approaching the winding frame part. In other words, the presence of the second core on the first winding frame part and the presence of the first core on the second winding frame part do not become obstacles each other to the winding of wires around the respective winding frame part. Consequently, the number of steps in manufacturing can be reduced compared to conventional core where re-chucking of the cross shape core had to be performed because the nozzle of a winding machine could not approach the first winding frame part or the second winding frame part due to the presence of the first core or the second core. This reducing manufacturing process improves production efficiency of a coil part.

Further, the cross shape core can be separated into the first core and the second core, and thus the nozzle of a winding machine can approach the respective winding frame part, making it possible to place a long flange at the respective ends of the first core and the second core, which is infeasible for the conventional non-separable cross shape core. This structure allows for an enhancement of the sensitivity of the coil parts and prevents their sizes from becoming too large.

Furthermore, a wire can be wound around each core independently, enabling a wire to be wired so that the outer end of the coil has a large radius while its center has a small radius. This winding was infeasible for the conventional non-separable cross shape core. Moreover, the first core and the second core exist as a separate unit before interlocking. This independency is able to increase the storage density per unit volume of the first core and the second core in case of transporting the first core and the second core which are stored in a storage, enhancing transportation efficiency.

In addition to the aspect of the invention, in the coil part, the first core may be interlocked with a second core so that the first direction is orthogonal to the second direction. A first interlocking part placed in the first core may include a first concave part formed as a concave shape and a first convex part formed as a convex shape. A second interlocking part placed in the second core may includes: a second convex part which is interlocked with the first concave part and formed as a convex shape; and a second concave part which is interlocked with the first convex part and formed as a concave shape.

With this additional aspect of the invention, due to the fact that the first core interlocks with the second core orthogonally, the cross shape core that results from the interlocking of the first core and the second core can receive radio signals in their respective directions efficiently and with high sensitivity. Moreover, interlocking the first concave part with the second convex part and the first convex part with the second concave part respectively enables a cross shape core to be formed in which the first core and the second core do not misalign with each other.

Further, in addition to the aspect of the invention, the first core and the second core have the same shape.

In this additional aspect, the identity in shapes of the first core and the second core brings unnecessity of distinguishing the two when producing the coil parts. This identity in shapes allows simplifying the production process and enhances production efficiency even further. Further the identity in shapes of the first core and the second core causes storage, transportation and maintenance to become simple since the cores do not need to be distinguished into two types.

In addition to the aspect of the invention, the coil part may further has flange that is placed on at least one of both ends of the at least one of the first core and the second core.

In this additional aspect, placing a flange enables to fix the position of a coil on at least one of the first winding frame part or the second winding frame part. The presence of a flange also makes it easier to wind a wire in order to form a coil. Furthermore, it allows increasing the volume of the core, and therefore enhancing its sensitivity.

In addition to the aspect of the invention, the coil part may further has a circumscribing coil that is separated from the coil placed in the first winding frame part and the coil placed in the second winding frame part. The circumscribing coil surrounds the cross shape core.

In this additional aspect, a circumscribing coil is placed so that it surrounds the cross shape core. This placement enables the circumscribing coil to be located in a direction so that its winding axis is orthogonal to that of the coil placed in the first winding frame part as well as to that of the coil placed in the second winding frame part. Further, this placement enables to form an antenna coil which receives radio waves in three axial directions well by implementing a circumscribing coil, the coil placed on the first winding frame part, and the coil placed on the second winding frame part. Further, this placement allows making the antenna coil thinner even though it is configured to receive radio waves in three axial directions well.

ADVANTAGE OF THE INVENTION

According to the coil part used for an antenna coil of the invention, it's production efficiency can be improved while its sensitivity is enhanced.

BRIEF EXPLANATION OF THE DRAWINGS

FIG. 1 is a perspective view of the configuration of a coil part for a first exemplary embodiment of the invention.

FIG. 2 is a perspective view in a disassembled form of the coil part shown in the FIG. 1.

FIG. 3 is a plain view of the configuration of the coil part shown in the FIG. 1.

FIG. 4 is a plain view of either a first core or a second core whichever a coil is wound, in the coil part shown in the FIG. 1.

FIG. 5 is a bottom view of either the first core or the second core whichever a coil is wound, in the coil part shown in the FIG. 1.

FIG. 6 is a side view of either the first or the second core whichever a coil is wound, in the coil part shown in the FIG. 1.

FIG. 7 is a front view of either the first core or the second core whichever a coil is wound, in the coil part shown in the FIG. 1.

FIG. 8 is a side view of the first core or the second core constituting the coil part shown in the FIG. 1.

FIG. 9 is a plain view of the first core or the second core constituting the coil part shown in the FIG. 1.

FIG. 10 is a partial perspective view of the interlocking part at the center of the first core or the second core shown, for example, in the FIG. 8.

FIG. 11 is a plain view related to the modified example for the coil part shown in the FIG. 1, where a long flange is placed.

FIG. 12 is a plain view related to the modified example for the coil part shown in the FIG. 1, where a number of times the wire is wound increases towards the outer end.

FIG. 13 is a plain view showing the configuration of an antenna coil related to a second exemplary embodiment of the present invention.

FIG. 14 is across sectional diagram of the antenna coil shown in the FIG. 13.

FIG. 15 is a perspective view of the case used for the antenna coil shown in the FIG. 13.

REFERENCE NUMERALS

10,10A . . . coil part
20 . . . core
20*a* . . . first core
20*b* . . . second core
20J . . . cross shape core
21 . . . central interlocking part (corresponding to the first interlocking part or the second interlocking part)
22 . . . winding frame part (corresponding to first winding frame part or the second winding frame part)
23 . . . flange
30 . . . coil
40 . . . case
41 . . . bottom wall
411 . . . landing part
412 . . . cross shape groove
413 . . . circumscribing groove
42 . . . lateral wall
50 . . . circumscribing coil
60 . . . connection terminal
211 . . . planar joint part
212 . . . upper convex parts (corresponding to a first convex part or a second convex part)
213 . . . lateral joint part
214 . . . upper concave part
215 . . . lateral concave part (corresponding to a first concave part or a second concave part)

THE PREFERRED EXEMPLARY EMBODIMENTS OF THE INVENTION

First Exemplary Embodiment

A coil part 10 used for an antenna coil related to a first exemplary embodiment of the present invention is explained below by referring to FIGS. 1 through 12. Furthermore, in the explanation below, the x-axis in FIG. 4 is set to be a long direction (corresponding to a first direction) and the y-axis is set to be a short direction (corresponding to a width direction, or a second direction).

As shown in FIGS. 1 through 3, the coil part 10 contains a first core 20*a*, a second core 20*b*, and a coil 30 that winds around the first core 20*a* or the second core 20*b*.

Of these, the first core 20*a* and the second core 20*b* have the same shape. Each of the first core 20*a* and the second core 20*b* includes a central interlocking part 21, a winding frame part 22, and a flange 23. Of these, the central interlocking part 21 is the part at which the first core 20*a* interlocks with the second core 20*b*.

Moreover, in the exemplary embodiment, due to the fact that the first core 20*a* and the second core 20*b* have the same shape, a core 20 is used as a label in the explanation below to refer to both of the first core 20*a* and the second core 20*b*. Furthermore, the cross shape core formed by the interlocking of the first core 20*a* with the second core 20*b* is called a cross shape core 20J. Moreover, the central interlocking part 21 on the first core 20*a* corresponds to the first interlocking part, while the central interlocking part 21 on the second core 20*b* corresponds to the second interlocking part. The winding frame part 22 on the first core 20*a* corresponds to the first winding frame part, while the winding frame part 22 on the second core 20*b* corresponds to the second winding frame part.

As shown in the FIG. 3 through FIG. 6, the planar configuration of the central interlocking part 21 is approximately a square. In other words, a length P in the long direction (refer to the FIG. 4) in the central interlocking part 21, and a length Q in the short direction in the central interlocking part 21 are of the same. Moreover, the central interlocking part 21 has a larger width than that of the winding frame part 22, and has function of positioning a wire 31 when it is wound around the winding frame part 22.

The planar view of the central interlocking part 21 (referring to FIG. 5, FIG. 9 and so on) shows that the central part contains a planar joint part 211. The planar joint part 211 has a planar shape of approximately a square in the exemplary embodiment. Moreover, in the exemplary embodiment, the length of each of the sides of the planar joint part 211 is approximately the same as that of the winding frame part 22. Furthermore, the thickness of the planar joint part 211 (the direction orthogonal to the x-axis and the y-axis in FIG. 4; the z-axis direction in FIG. 10) is set to be approximately a half of the thickness of the winding frame part 22.

As shown in FIGS. 4 through 10, between the planar joint part 211 and the winding frame part 22 within the central interlocking part 21, an upper convex part 212 is located. In the exemplary embodiment, from a plain view of the central interlocking part 21, the planar joint part 211 is located in the center. Therefore, the upper convex parts 212 are located on lateral sides of the planar joint part 211. This upper convex part 212 has approximately the same width as the planar joint part 211. Moreover, in the exemplary embodiment, the upper surface of the upper convex part 212 (the surface on the side on which the upper convex part 212 exists viewed from a base part 216 in the FIG. 10; same in what follows) is approximately coplanar with the upper surface of the winding frame part 22. Furthermore, the thickness of the upper convex part 212 is set to approximately a half of the thickness of the winding frame part 22.

Furthermore, in the central interlocking part 21, lateral joint parts 213 are located. The lateral joint parts 213 stretch towards the short direction (y-axis direction) from a part along the long direction (x-axis direction) that it shares with the upper convex parts 212. Moreover, the upper surface of the lateral joint parts 213 are at the same height as that of the planar joint part 211, and the lower surface of the lateral joint parts 213 are also at the same height as (or coplanar with) that of the planar joint part 211. Consequently, the thickness of the lateral joint part 213 is approximately a half of that of the winding frame part 22. Furthermore, in the exemplary embodiment, the lateral joint parts 213 are placed in two sets of pairs along the opposite sides of the short direction in total of four. That is, one pair is placed at the ends of the planar joint part 211 on one side of the short direction, and other pair is placed at the ends of the planar joint part 211 on the other side of the short direction.

Furthermore, the distance between one protruding part and the other of the lateral joint parts 213 located at the opposite sides of the short-arm axis is set to the distance Q[=distance P]. In below, the concave part between the pair of upper convex parts 212 when viewed from the side (refer to FIGS. 6, 8 and 10) is referred to as an upper concave part 214. In a similar manner, the concave part between the lateral joint parts 213 when viewed as a plane view (refer to FIGS. 4, 5, 9, and 10) is referred to as a lateral concave part 215. Furthermore, the planar joint part 211 equips a base part 216 which forms a basis from which the upper convex parts 212 and the lateral joint part 213 protrudes (refer to FIG. 10). This base part 216, the upper convex parts 212 and the pair of lateral joint parts 213 together form an approximately convex shape when viewed from the front.

The upper convex part 212 on the first core 20*a* corresponds to the first convex part, while the lateral concave part 215 on the first core 20*a* corresponds to the first concave part. The upper convex part 212 on the second core 20*b* corresponds to the second convex part, while the lateral concave part 215 on the second core 20*b* corresponds to the second concave part.

A winding frame part 22 stretches from the two ends of the central interlocking part 21 along the long direction (x-axis). The winding frame part 22 is the part around which the coil 30 is placed. This winding frame part 22 is approximately of the same width as the planar joint part 211. Furthermore, the upper surface of the winding frame part 22 is coplanar with the upper convex parts 212. In the exemplary embodiment, the length of the winding frame part 22 in the long direction (x-axis) is set to be longer than that of the central interlocking part 21.

A flange 23 is located at the ends of the winding frame part 22 away from the central interlocking part 21. The flange 23 is wider (the length along the Y-axis direction) than the winding frame part 22. The width of the flange 23 is set in such a way to aid in an effective placing of the coil wire 31 on the winding frame part 22. In the exemplary embodiment, the upper surface of the flange 23 is coplanar with that of the winding frame part 22. Consequently, the thickness of the flange 23 is the same as that of the winding frame part 22.

Furthermore, winding a coil wire 31 around the winding frame part 22 by a prescribed number of times forms a coil 30 around it. In the exemplary embodiment, the one end of the coil wire 31 stretches beyond the outer side of the one of the flange 23 along the long direction, while the other end of the coil wire 31 also stretches beyond the outer side of the other flange 23 along the long direction. Thus, the both ends of the coil wire 31 can be connected to connection terminals which are not shown.

Further, as shown in FIG. 1 through FIG. 4, the coil wire 31 bridges over the central interlocking part 21 to join with the coil 30 located on the winding frame part 22 on the other side.

At this point, the coil wire 31 is located below the central interlocking part 21 and bridges over it diagonally along the short direction.

As mentioned above, the core 20*a* and the core 20*b* are locked together at their respective central interlocking parts with the coils 30 already wound in their respective places. This proceeds so that the long direction of the two cores 20*a* and 20*b* are orthogonal to each other and so that the respective upper surfaces of the planar joint parts 21 as well as the respective upper surfaces of the lateral joint parts 213 are joined along their planes. This also proceeds in a manner so that the upper convex parts 212 locks into the lateral concave part 215.

In case of joining the respective central interlocking parts 21, the first core 20*a* and the second core 20*b* may be fixed in place by interlocking the central interlocking parts 21 after applying glue. Alternatively, the first core 20*a* and the second core 20*b* may be fixed in place by covering the outside of the central interlocking parts 21 with a resin after the first core 20*a* and the second core 20*b* are joined. In this way, a coil parts 10 with a cross shape such as it is shown in the FIG. 3 can be formed.

In the coil parts 10 explained above, the cross shape core 20 J is formed by interlocking the central interlocking part 21 of the first core 20*a* with the central interlocking part 21 of the second core 20*b*. Accordingly, in forming the coil 30, the coil wire 31 can be wound around each of the winding frame parts 22 to the first core 20*a* and the second core 20*b* separately, as they are detached from each other.

Consequently, in winding the coil wire 31 around each of the winding frame parts 22, the nozzle of a winding machine can get close to the winding frame part 22. In the conventional cross shape core 20J, the second core that stretches along the y-axis direction was an obstacle to the nozzle of a winding machine when winding the coil wire 31 around the winding frame part of the first core that stretches along the x-axis direction. In the cross shape core 20J of the exemplary embodiment, due to the fact that the first core 20*a* and the second core 20*b* can be detached from each other, the presence of the second core 20*b* against the winding frame part 22 of the first core 20*a*, or the presence of the first core 20*a* against the winding frame part 22 of the second core 20*b* do not become obstacles when winding the coil wire 31 around their respective winding frame parts 22. Therefore, re-chucking of the cross shape core 20J, which was necessary because the nozzle of a winding machine could not approach the respective winding frame part 22 in the conventional cross shape core, is no longer necessary. Hence, the number of manufacturing steps is reduced. Consequently, it becomes possible to enhance the production rate of the coil parts 10.

Furthermore, the cross shape core 20J can be separated into the first core 20*a* and the second core 20*b* and this separated configuration causes the nozzle of a winding machine to approach the respective winding frame parts 22. Hence, this configuration enables long flanges to be fixed on the ends of the first core 20*a* and the second core 20*b*, which was infeasible in the conventional inseparable conventional cross shape core. Such an aspect is shown in the FIG. 11. Fixing a long flange 23 L as shown in the FIG. 11 makes it possible to enhance the sensitivity of the coil parts 10 while preventing its over sizing.

Furthermore, the coil wire 31 can be wound around the core 20*a* and 20*b* independently, making it possible to wind the coil wire 31 in such a way so that the outer ends of the coil have larger radii compared to the central part of the coil. Such a formation shown in the FIG. 12 was impossible in the conventional inseparable cross shape core. As shown in FIG. 12, increasing the number of times of winding the coil wire 31 compared to, for instance, that in the aspect of FIG. 3 makes it possible to enhance the sensitivity of the coil parts 10 while preventing its over sizing. Furthermore, the coil parts 10 shown in the FIG. 12 makes more efficient use of the space by stretching the coil 30 outward into the four corner spaces of the coil parts 10 shown in the FIG. 3.

In the exemplary embodiment of the coil parts 10, the first core 20*a* and the second core 20*b* are independent from each other before interlocking them. Therefore, in case of transporting the first core 20*a* and the second core 20*b* which are stored in a storage, the storage density of the first core 20*a* and the second core 20*b* per unit volume inside the storage can be increased. This enhances transportation efficiency.

Since the first core 20*a* and the second core 20*b* are interlocked orthogonally to each other, the cross shape core 20 J that results from their interlocking can receive radio waves in their respective directions well. Moreover, the upper convex parts 212 and the lateral concave parts 215 are joined, making it possible to form the cross shape core 20J in which the first core 20*a* and the second core 20*b* do not misalign with each other.

Furthermore, in the exemplary embodiment, the first core 20*a* has the same shape as the second core 20*b*, making it unnecessary to distinguish the two when manufacturing the coil parts 10, simplifying production processes and enhancing further production efficiency. This identity in shape of the first core 20*a* and the second core 20*b* makes it unnecessary to distinguish the two types of cores 20*a* and 20*b* when transporting them, enabling the cores 20*a* and 20*b* to easily be maintained.

In the exemplary embodiment, the flanges 23 and 23L are fixed onto the ends of each of the first core 20*a* and the second core 20*b*. Therefore, the coil 30 can be effectively positioned along each of the winding frame part 22. Moreover, the presences of the flanges 23, and 23L, makes it easier to wind the coil wire 31 around the winding frame part 22 in order to form the coil 30. Accordingly, the sensitivity is enhanced.

Second Exemplary Embodiment

A second exemplary embodiment of the invention is explained below by referring to the FIGS. 13 through 15. In the second exemplary embodiment, the same reference numerals are used to refer to the parts that are same as that of the first exemplary embodiment.

An antenna coil 100 of the exemplary embodiment is formed using coil parts 10A which is the same as the coil parts 10 from the first exemplary embodiment.

Furthermore, as shown in the FIG. 14, a winding frame part 22A of a core 20 is coplanar with upper convex parts 212. However, the thickness of a winding frame part 22A is thinner than the winding frame part 22 in the first exemplary embodiment. Consequently, the bottom surface of the winding frame part 22A is not coplanar with that of the central interlocking part 21 and therefore, it caves in towards the upward direction in the FIG. 14.

Moreover, the other parts of the coil parts 10A are substantially the same as that of the coil parts 10.

Furthermore, the antenna coil 100 in the exemplary embodiment further contains a case 40, a circumscribing coil 50 and a connection terminal 60 as shown in the FIG. 13 and the FIG. 14. The case 40 includes a bottom wall 41, and a pair of lateral walls 42. The bottom wall 41 is the part of the case 40 with the largest area which touches or faces with an outer case or a mounting board which are not shown. A landing part 411 is placed in the bottom wall 41. The landing part 411 protrudes upward by a predetermined height from the upper surface of the bottom wall 41. In the exemplary embodiment, the height of the landing part 411 is set to be smaller than that of the lateral wall 42.

Furthermore, in the exemplary embodiment, the landing part 411 has a planar shape of either a circle or a polygon that is divided equally into four. Moreover, the four landing parts 411 are placed in equal distances to each other. Consequently, on the upper surface of the bottom wall 41 and between the landing parts 411 is formed a cross shaped groove 412 that has approximately a cross planar shape. Furthermore, the coil part 10A is placed inside the cross shape groove 412. The placing of the coil parts 10A is then determined by the four landing parts 411. Consequently, the distances between the landing parts 411 is set to be slightly larger than the width of the coil part 10A.

Furthermore, the landing part 411 and the lateral wall 42 are set apart by a prescribed distance. Consequently, between a peripheral portion 411*a* of the landing part 411 and the lateral wall 42 is formed a circumscribing groove 413 having a planar circumscribing shape. Moreover, the circumscribing groove 413 is joined with the cross shape groove 412.

Moreover, a circumscribing coil 50 such as that in the FIG. 13 is placed inside the circumscribing groove 413. The circumscribing coil 50 is independently prepared from the coil 30. Furthermore, in the exemplary embodiment, the circumscribing coil 50 is approximately in a square shape. Moreover, the circumscribing coil 50 surrounds the cross shape core 20J and the coil parts 10A that contains it.

Moreover, the connection terminal 60 is placed along the exterior of the case 40. The connection terminal 60 is the part mounted on an exterior circuit board by soldering. The connection terminal 60 is electrically connected to a wire 31 and 51 located inside the case 40.

In the antenna coil 100 having the above configuration, the coil part 10A can achieve the same effect as the coil part 10 in the first exemplary embodiment. These same effects due to the coil parts 10 are the simplification of the winding of the wire 31, an increase in the production rate of the coil parts 10A, and enhancement of transportation efficiency.

Furthermore, the antenna coil 100 in the exemplary embodiment is provided with the case 40 and the circumscribing coil 50 in addition to the coil parts 10A containing a cross shape core 20J. This additional provision in the antenna coil 100 of the exemplary embodiment enables the winding axis of the circumscribing coil 50 to be set orthogonal to that of the coil 30 placed on the winding frame part 22 of the first core 20*a* and to the coil 30 placed on the winding frame part 22 of the second core 20*a*. Accordingly, these winding axis directions make it possible to receive radio waves in three directions well without a bias in any one direction. Thus, the reception sensitivity of the antenna coil 100 is enhanced. Moreover, even though the antenna coil 100 has an aspect to receive the radio wave in three axial directions, its thin construction becomes possible.

Thus far, the antenna coil 100 that uses the coil parts 10 and the coil parts 10 are explained. This invention can be modified in various ways as discussed below.

In each of the exemplary embodiments, the first core 20*a* and the second core 20*b* possess winding frame part 22 on each of the both ends of the central interlocking part 21 along the long direction. However, the first core 20*a* or the second core 20*b* may not necessarily possess the winding frame part 22 on each both ends of the central interlocking part 21 along the long direction, but only on one of the ends.

Moreover, in the second exemplary embodiment, the antenna coil 100 is a three-axis coil. But, the antenna coil 100 is not limited to a three axis coil, but may also be a two axis coil.

Furthermore, in each of the exemplary embodiments, the first core 20*a* and the second core 20*b* respectively are provided with the upper convex parts 212 and the lateral concave part 215 so that they interlock with each other. However, it may be possible to reverse the convexity and the concavity relationship in the above when forming the first core 20*a* and the second core 20*b*.

Furthermore, in the above exemplary embodiments, the upper convex parts 212 of the first core 20*a* corresponds to the first convex part, and the lateral concave part 215 of the first core 20*a* corresponds to the first concave part, while the upper convex part 212 of the second core 20*b* corresponds to the second convex part and the lateral concave part 215 of the second core 20*b* corresponds to the second concave part. However, the first convex part, the first concave part, the second convex part and the second concave part are not limited to this aspect. Any configuration of convexity and concavity that enables a good interlocking of the first convex part with the second concave part and the first concave part with the second convex part may be used.

Furthermore, the lateral joint part 213 of the first core 20*a* may correspond to the first convex part and a concave part located at a corner that neighbors the lateral joint part 213 on the central interlocking part 21 of the first core 20*a* may correspond to the first concave part. In this setting, the lateral joint part 213 of the second core 20*b* corresponds to the second convex part while a concave part located at a corner that neighbors the lateral joint part 213 on the central interlocking part 21 of the second core 20*b* corresponds to the second concave part.

Moreover, in each of the exemplary embodiments, the first core 20*a* and the second core 20*b* is interlocked orthogonally to each other. However, the first core 20*a* and the second core 20*b* may also be interlocked in an oblique manner with a prescribed angle.

Moreover, in the above exemplary embodiment, the cross shape core 20 J is formed by interlocking the first core 20*a* with the second core 20*b*. But, the first core 20*a* and the second core 20*b* may each be formed from the interlocking of plural cores.

Furthermore, in the above exemplary embodiment, the first core 20*a* and the second core 20*b* have the same shape. But, the first core 20*a* may have a different shape from the second core 20*b*.

In the above exemplary embodiments, the flanges 23 and 23L are placed on both ends of the first core 20*a* and the second core 20*b*. But, the flanges 23 and 23L may be placed on at least one end of at least one of the first core 20*a* or the second core 20*b*. Even in this setting, the placing of the coil 30 can be determined at the part on which the flanges 23 and 23L is placed. Therefore, the sensitivity can be enhanced.

INDUSTRIAL APPLICABILITY

The coil parts of the present invention can be used in the filed of electrical equipments and electronic devices.

The invention claimed is:

1. A coil part used in a antenna coil comprising:

a cross shape core that comprises a first winding frame part extending in a first direction and being provided with a coil, and a second winding frame part extending in a second direction crossing the first direction and being provided with a coil, wherein a first core including the first winding frame part is interlocked with a second core including the second winding frame part so that the first direction is orthogonal to the second direction, a first interlocking part placed in the first core includes a first concave part formed as a concave shape and a first convex part formed as a convex shape, and a second interlocking part placed in the second core includes a second convex part which is interlocked with the first concave part and formed as a convex shape, and a second concave part which is interlocked with the first convex part and formed as a concave shape.

2. The coil part according to claim 1, wherein each of the first interlocking part and the second interlocking part is formed as a square in the planar configuration with a larger width than that of the winding frame parts and contains;

a planar joint part having a planar shape of a squire with the length of each side being approximately the same as that of the winding frame parts with the thickness set to be a half of the thickness of the winding frame parts, two convex part as the first or second convex part located between the planer joint part and the winding frame part within the interlocking part with the thickness set to be a half of the thickness of the winding frame parts, and lateral joint parts forming the first or second concave part within the square planar configuration of the first or second interlocking part, the upper surface of lateral joint parts being at the same height as that of the planar joint part.

3. The coil part according to claim 1, wherein a coil wire forming the coil on each of the first and second winding frame parts is wound around the first and second cores independently so that the outer ends of the coil have larger radii compared to the central part of the coil.

4. The coil part according to claim 1, wherein the coil is stretched outward into four corner spaces of the cross shape core.

* * * * *